United States Patent [19]

Eventoff

[11] 4,301,337

[45] Nov. 17, 1981

[54] DUAL LATERAL SWITCH DEVICE

[76] Inventor: Franklin N. Eventoff, 2351 Lake View Ave., Los Angeles, Calif. 90039

[21] Appl. No.: 135,386

[22] Filed: Mar. 31, 1980

[51] Int. Cl.[3] ..... H01H 13/70; G10H 1/00

[52] U.S. Cl. ..... 200/5 A; 84/1.01; 84/DIG. 7; 200/159 B

[58] Field of Search ..... 84/1.01, 1.25, DIG. 7; 200/5 A, 159 B; 340/365 R

[56] References Cited

U.S. PATENT DOCUMENTS

| | | | |
|---|---|---|---|
| 3,982,081 | 9/1976 | Delmer, Jr. | 200/5 R |
| 3,987,259 | 10/1976 | Larson | 200/5 A |
| 3,988,551 | 10/1976 | Larson | 200/5 A |
| 4,066,851 | 1/1978 | White et al. | 200/292 X |

*Primary Examiner*—James R. Scott

*Attorney, Agent, or Firm*—Nilsson, Robbins, Dalgarn, Berliner, Carson & Wurst

[57] ABSTRACT

A dual switch apparatus has two switches simultaneously actuated in response to a single touch force where at least one of the switches has a pressure responsive variable contact resistance. A first support member has a first and a second conductor disposed thereon and a second support member has a third and a fourth conductor disposed thereon so that the first and third conductors and the second and fourth conductors have mirror image conductor patterns. A semiconducting composition layer is disposed to cover at least one of the four conductors. The first and second support members are positioned facing one another with the first and third conductors and the second and fourth conductors transversely aligned so that a transverse force causes the first and third conductors and the second and fourth conductors to move into electrically conducting relationship. A spacer maintains the first and second support members in normally spaced relationship. A utilization circuit may be coupled across each of the first and third and second and fourth conductors. In one embodiment, the first conductor has two electrically isolated contact members with interdigiting fingers with the third conductor acting as a shunt.

12 Claims, 3 Drawing Figures

DUAL LATERAL SWITCH DEVICE

BACKGROUND OF THE INVENTION

The present invention relates to switches and in particular to dual touch switch devices defining a pair of switches simultaneously closed in response to a single transverse touching force where at least one of the switches has a pressure responsive variable contact resistance.

Switching devices which are operable in response to the application of a transverse touching force are known. Frequently, however, it is desirable to perform several independent switching functions simultaneously upon the application of a single transverse touch force. For example, battery powered musical instruments have recently been developed wherein the keyboards consist of touch sensitive switches interconnected in resistive networks to thereby replace strings or keys utilized on conventional instruments. In such instruments it is desired to be able to generate two tones to form a two note chord by the application of a single transverse touching force. It is also desired to provide a switching device which will allow one of the tones to vary slightly in frequency while the other tone remains of a constant frequency. Such a variation in tone of one note in a dual note chord generates a novel and unusual sound effect in the musical instrument.

The present invention provides a dual switch touch sensitive structure where the dual switches are simultaneously actuated in response to a single touching force. Further, the present invention provides a semiconducting composition over the switch conductors (contacts) of at least one of the switches so that the resistance across the contact of that switch (contact resistance) varies inversely to the amount of force which is transversely applied to close the two switches. Thus, by rapidly increasing and decreasing the transverse force such as by rapidly moving the finger pressing downwardly on the switch, a verbrato or tremolo effect in one tone can be generated without varying the frequency of the tone in the other switch.

SUMMARY OF THE INVENTION

The present invention comprises a tone generating device comprising a switch apparatus defining a pair of switches simultaneously actuated in response to a single transverse force, a first utilization circuit coupled across one of the pair of switches and a second utilization circuit coupled across the other of the pair of switches. The switch apparatus comprises a support member which has a first and second portion or alternatively comprises a pair of support members. A first conductor is then disposed on a first support member portion in a first conductor pattern and a second conductor is disposed on the first support member portion in a second conductor pattern. Similarly, a third conductor is disposed on the second support member portion in a pattern which is the mirror image of the first conductor pattern and a fourth conductor is disposed on the second support member portion in a pattern which is the mirror image of the second conductor pattern. The first and second portions of the support member are folded in one embodiment into a juxtaposed alignment opposite one another in normally spaced relationship with the first and third conductors and the second and fourth conductors transversely aligned in simultaneous actuating proximity. The first and third conductors are thus transversely movable into electrically conducting relationship and the second and fourth conductors are transversely movable into electrically conducting relationship in response to the application of the single transverse force. Finally, a pressure responsive semiconducting composition is disposed between at least one of the first and third pair of conductors and the second and fourth pair of conductors for providing a contact resistance across either the first and third conductors or across the second and fourth conductors or across both the first and third conductors and the second and fourth conductors. The contact resistance varies inversely to the magnitude of the single transverse force.

The dual switch apparatus may further comprise a spacer surrounding the first, second, third and fourth conductors for maintaining the first and third conductors and the second and fourth conductors in the normally spaced apart relationship.

DETAILED DESCRIPTION OF THE DRAWINGS

A complete understanding of the present invention and of the above and other advantages thereof may be gained from a consideration of the following description of the preferred embodiments taken in conjunction with the accompanying drawings in which.

DETAILED DESCRIPTION

The present invention comprises a novel switch apparatus which functions generally as a double-pole, single-throw switch whereby two independent switches are simultaneously actuated, that is, closed, in response to a single transverse touch force. In addition, at least one of the switches of the present invention is pressure responsive so that the amount of voltage drop across the switch varies inversely to the amount of touching pressure applied against the switch.

Figure 1:
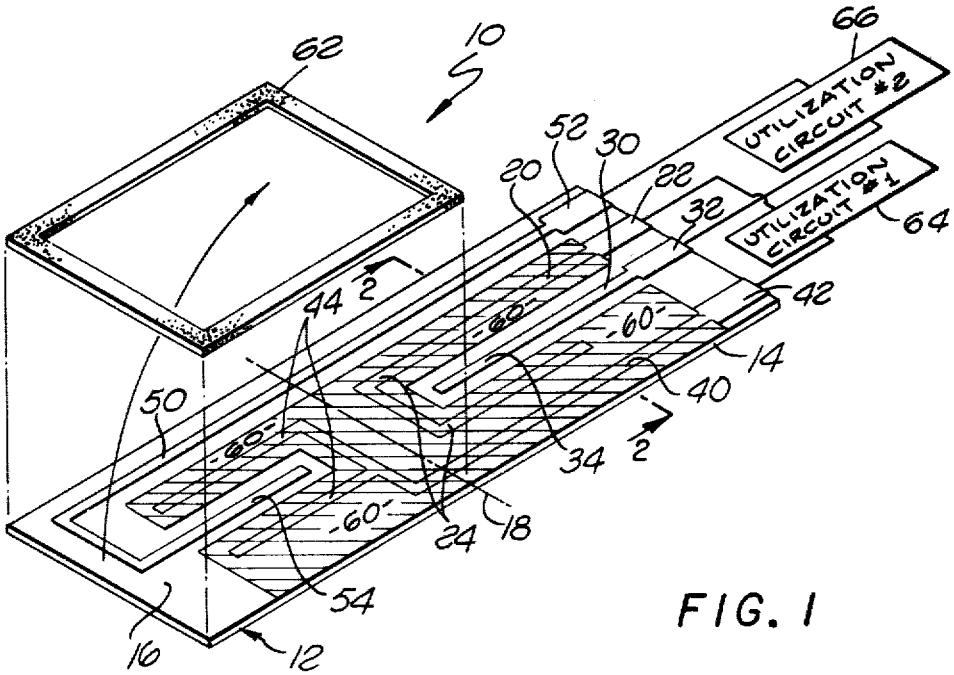
FIG. 1 is an exploded partial pictorial partial schematic diagram of the present invention in an unfolded, open configuration.
Figure 2:
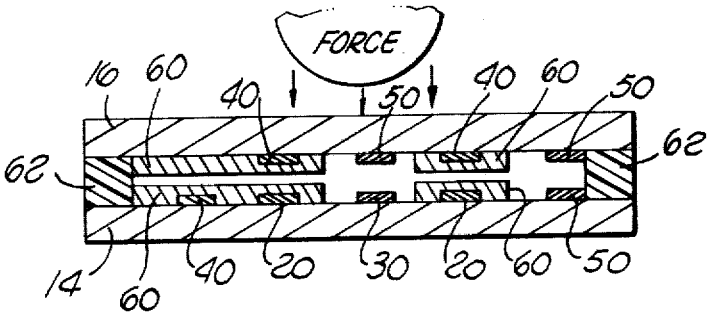
FIG. 2 is a cross sectional side view of the switch apparatus shown in FIG. 1 in the folded operating configuration through section 2—2.

Referring to FIGS. 1 and 2, a pressure actuated dual switch apparatus 10 in accordance with the preferred embodiment of the invention, has a support member 12 which may be made out of a flexible resilient material such as a thin sheet of Mylar. The support member 12 has a first or bottom portion 14 and a second or top portion 16. The first portion 14 and the second portion 16 of the support member are defined by a fold line 18 along which the second portion 16 is folded into an overlaying, but spaced apart, relationship relative to the first portion 14.

A plurality of conductors are then disposed on one side of the support member 12. Specifically, a first conductor 20 electrically interconnected to a first terminal 22 is disposed on the surface of the support member 12 in a first pattern 24 which may be any pattern but is illustrated in FIG. 1 as the U-shaped pattern. A second conductor 30, electrically coupled to a second terminal 32, is disposed on the top of the support member 12 in a second pattern 34 which in FIG. 1 is simply a straight conductor pattern positioned between the legs of the U-shaped first pattern 24 of the first conductor 20. The first pattern 24 and the second pattern 34 of the first conductor 20 and the second conductor 30, respectively, are disposed on the first portion 14 of the support member 12.

A third conductor 40 is electrically interconnected to a third terminal 42 and is disposed on the second portion 16 of the support member 12 in a conductor pattern 44 which is the reciprocal or mirror image of the first conductor pattern 24. Finally, a fourth conductor 50 is electrically interconnected to a fourth terminal 52. The fourth conductor 50 is disposed across the first portion 14 and onto second portion 16 of the support member 12. The fourth conductor 50 is disposed on the second portion 16 of the support member 12 in a pattern 54 which is the reciprocal, i.e., mirror image, of the second pattern 34.

In accordance with the invention a semiconductor composition 60 is then disposed on top of at least one of the first, second, third or fourth conductors. Of course, it will be appreciated that the semiconducting composition 60 may be disposed on top of several of the conductors as shown in FIG. 1 where the semiconductor composition is disposed on top of the first and third conductors 20 and 40, respectively. Thus, direct electrical contact to the conductor on which the semiconducting composition 60 is disposed will not occur. Rather, electrical contact must be made through the semiconducting composition layer. This effectively provides a contact resistance between conductors 20 and 40 so that electrically there is a resistance in series with the switch defined by the conductors 20 and 40.

The semiconducting composition layer 60 may be any suitable material which is sprayable, screenable or otherwise of a consistency which may be evenly applied to form a smooth exposed surface covering the conductor. For example, the semiconductor material may be molybdenum disulphide particulate having particle sizes on the order of 1 to 10 microns mixed with a binder material such as resin to form a liquid. A resin thinner may be added to give the composition a consistency suitable for spraying. It will be appreciated that the semiconducting composition may be of any thickness so long as there is an exposed smooth semiconducting surface. However, in order to conserve on semiconductor material and to minimize surface irregularities which may occur when thick semiconducting composition layers are utilized, a thickness on the order of about 0.001 inch or less is preferred.

A dual pressure actuated switch structure in accordance with the invention may be formed by folding the support member 12 along the fold line 18 so that the second portion 16 is aligned over the first portion 14 so that the pattern portions of first conductor 20 and the third conductor 40 are in transverse alignment and the pattern portions of the second conductor 30 and fourth conductor 50 are in transverse alignment. Thus, the first and third conductors comprise the contacts for one switch and the other and fourth conductors comprise the contacts for the second switch in the dual switch apparatus.

A spacer 62 is positioned around the conductors between the first portion and the second portion to maintain the first and third conductors 20 and 40 and the second and fourth conductors 30 and 50 in a normally spaced apart relationship. In addition, it will be appreciated that the first and second conductors 20 and 30 on the first portion 14 and the third and fourth conductors 40 and 50 on the second portion 16 must be in close lateral proximity to allow a single transverse force to cause the first and third conductors 20 and 40 and the second and fourth conductors 30 and 50 to simultaneously move into electrically conducting relationship.

The switch device described above may be utilized in a musical instrument and specifically may be used in a musical instrument having first and second utilization circuits 64 and 66 where the first utilization circuit 64 may generate a first tone having a first frequency and the second utilization circuit 66 may generate a second tone having second frequency or may be coupled to control, for example, the volume of the first tone. The utilization circuits 64 and 66 may be of any suitable circuit configuration such as that described in U.S. Pat. Nos. 3,609,203, or 3,795,756 where the tone can be varied by varying the value of a selected resistor in the circuit. One significant advantage of the present invention is that the semiconducting composition layer 60 allows the resistance in one of the utilization circuits to be varied in response to the actuating pressure.

Two tones or two parameters of one tone can thus be simultaneously generated by depressing the dual switch in accordance with the invention with the finger to exert a force as illustrated in FIG. 2. This transverse force causes the first and second switches defined by the first and third conductors 20 and 40 and the second and fourth conductors 30 and 50, respectively, to close. The semiconducting composition layer 60 disposed on the first and third conductors 20 and 40 as illustrated in FIGS. 1 and 2 prevent the first and third conductors 20 and 40 from contacting directly so that when the switch represented by the first and third conductors 20 and 40 closes, current flows across the contact through the semiconducting composition layer 60. By varying the amount of force with which the semiconductor composition layers are contacted, the amount of contact resistance can be varied in one of the utilization circuits. Thus, in one preferred embodiment of the invention, variations in the finger pressure applied to the switch apparatus causes the frequency of sound generated by the first utilization circuit 64 to vary while the frequency from the other utilization circuit 66 which does not incorporate the semiconducting composition layer remains constant. Such a switch apparatus allows for a unique and unusual tone effect for a musical instrument.

It will be appreciated of course that many variations in the particular structure of the present invention are possible. For example, the patterns formed by the conductors on the support member may have any configuration so long as the conductors for the respective two switches are sufficiently close together to allow simultaneous actuation by the finger of an operator. In addition, the support member may be made in two sections with the first and third terminals attached to one support member and the second and fourth terminals attached to the second support member.

In this embodiment, only one of the support members needs to be flexible. Consequently, the other support member may be rigid.

Of course, it will be appreciated that the dual switch of the present invention may be used in many other applications. For example, one switch may be coupled between a circuit and the power supply to turn the circuit on and off while the other switch is interconnected to vary a circuit parameter to effect, for example, a volume change.

It will also be appreciated that one significant advantage of the above-described semiconductor composition layer is that it makes the switch incorporating it virtually bounceless. Thus, the semiconductor composition provides a contact resistance that prevents the signal spikes which occur when the switch contacts initially touch.

Figure 3:
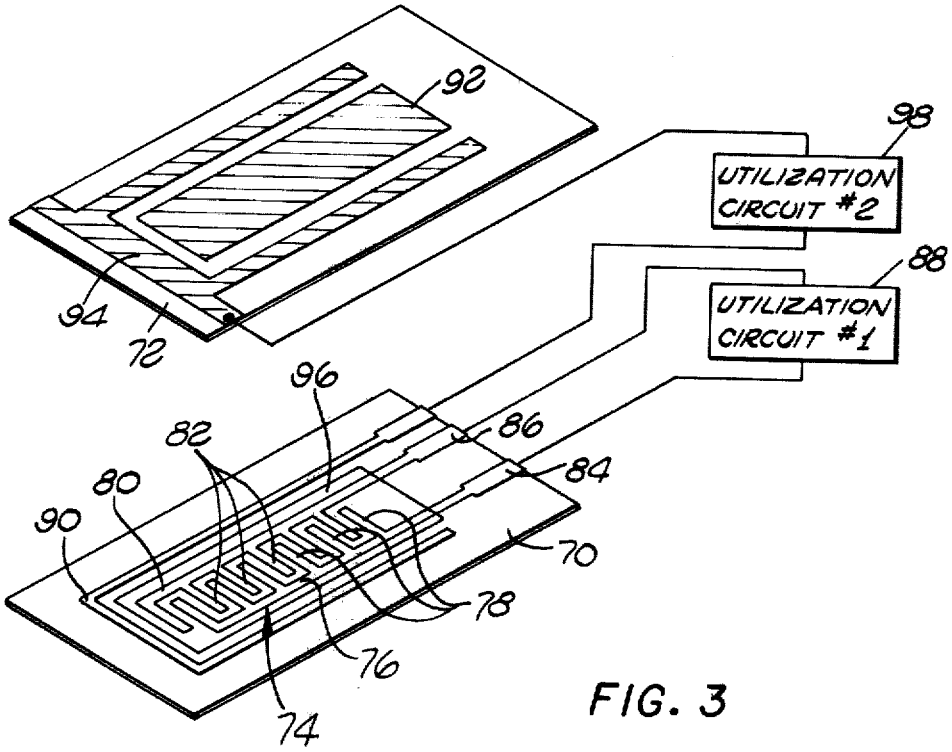
FIG. 3 is an exploded partial pictorial, partial schematic of a second embodiment invention.

Referring now to FIG. 3, another embodiment of the invention is shown comprising a first base member 70 which may be a flexible Mylar material, a rigid plastic material or any other suitable nonconducting support member, and a second base or support member 72 in transversely spaced relationship with the first base member 70. A first conductor 74 is disposed on the surface of the first base member 70. The conductor 74 includes a first contact member 76 with a plurality of interdigiting fingers 78 and a second contact member 80 also with a plurality of interdigiting fingers 82. The first contact member 76 is electrically interconnected to a first terminal 84 and the second contact member 80 is electrically interconnected to a second terminal 86. A first utilization circuit 88 may then be electrically coupled between the first terminal 84 and the second terminal 86 in the manner previously described in connection with the embodiment of FIG. 1.

A second conductor 90 is likewise disposed on the surface of the first base member 70. The second conductor 90 has a pattern which in one embodiment is a U-shaped pattern disposed around the first conductor 74. As in the previous embodiment, the first conductor 74 and the second conductor 90 are laterally displaced on the first base member in sufficiently close proximity so that a single transverse touch force will simultaneously actuate the switches respectively including the first conductor 74 and the second conductor 90.

The embodiment of the invention as illustrated in FIG. 3 also comprises a third conductor 92 disposed on one surface of the second base member 72 in facing, aligned relationship with the first conductor 74, and a fourth conductor 94 disposed on the same surface of the second base member 72 in facing, aligned relationship with the second conductor 90. Hence, the first conductor 74 and third conductor 92 comprise the contacts of a first switch and the second conductor 90 and the fourth conductor 94 comprise the contacts of a second switch of the present invention.

In the preferred embodiment the third conductor 92 is simply an electrically isolated conductive portion on the second base member 72 having a size sufficient to overlay or cover the entire first conductor 74. The fourth conductor 94 has a size and shape corresponding to the second conductor 90. The first, second, third and fourth conductors 74, 90, 92 and 94 may be of any appropriate material and may, for example, be a thin layer of sprayed-on silver, a thin layer of copper, or other suitable conductive material.

In order to provide a variable contact resistance, a semiconducting composition 96, somewhat similar to that previously described, may be disposed to cover the first conductor 74. Alternatively, the semiconducting composition 96 may be disposed to cover the third conductor 92 or, if both switches are desired to have a variable contact resistance, the semiconducting composition may be disposed on one or both of the second and fourth conductors 90 and 94.

In yet another alternative embodiment, the semiconductor composition layer 96 may be omitted and the third conductor 92 provided to be made solely of the semiconductor composition. In such an embodiment, a separate conductive layer such as the silver or copper layer previously described, need not be provided for the third conductor 92. Of course, it will be appreciated that this latter embodiment is possible because the distance between each of the interdigiting fingers 78 and 82 is sufficiently close that the lateral resistance through the semiconducting composition layer comprising the third conductor 92 is relatively low when maximum transverse pressure is applied.

Finally, a second utilization circuit 98 may be interconnected between the second conductor 90 and the fourth conductor 94.

One advantage of this latter embodiment is that a plurality of similar dual switch apparatus may be arranged in a keyboard arrangement with each fourth contact of each separate dual switch arrangement being interconnected in a common buss configuration thereby minimizing the number of electrical contacts which must be made to interconnect the plurality of dual switches in the keyboard arrangement.

Thus, while the present invention has been particularly shown and described with reference to preferred embodiments, it will be understood by those skilled in the art that the foregoing and other changes in form and details may be made without departing from the spirit and scope of the invention.

What is claimed is:

1. A dual switch apparatus defining two independent switches simultaneously actuated in response to a single transverse force comprising:

a first support member;

a first conductor disposed on the first support member;

a second connector disposed on the first support member;

a second support member;

a third conductor disposed on the second support member;

a fourth conductor disposed on the second support member;

the first and second support members juxtaposed opposite one another in normally spaced apart relationship with the first and third conductors and the second and fourth conductors laterally spaced in simultaneous actuating proximity, the first and third conductors transversely movable into electrical conducting relationship and the second and fourth conductors transversely movable into electrical conducting relationship in response to application of the single transverse force, the first and third conductors defining a first switch and the second and fourth conductors defining a second switch; and a pressure responsive semiconducting composition disposed for providing a contact resistance across at least one of the first and second switches, the contact resistance varying in response to variations in the magnitude of the single transverse force.

2. The dual switch apparatus of claim 1 wherein the first conductor comprisers:

a first contact member; and a second contact member, the first and second contact members being electrically isolated with the third conductor providing a shunt for electrically coupling the first and second contact members in response to the application of the single transverse force.

3. The dual switch apparatus of claim 2 wherein the first and second contact members each have a plurality of interdigiting fingers.

4. The dual switch apparatus of claim 2 or 3 wherein the third conductor comprises the pressure responsive semiconducting composition.

5. The dual switch apparatus of claims 2 or 3 wherein the pressure responsive semiconducting composition is disposed for overlying at least one of the first, second, third and fourth conductors for providing a contact resistor thereon.

6. The dual switch apparatus of claim 1 further comprising a spacer surrounding the first, second, third and fourth conductors for maintaining the first and third conductors and the second and fourth conductors in the normally spaced apart relationship.

7. A dual switch apparatus defining two independent switches simultaneously actuated in response to a single transverse force comprising:

a foldable support member having a first portion and a second portion;

a first conductor disposed on the support member and defining a first pattern on the first portion;

a second conductor disposed on the support member and defining a second pattern on the first portion;

a third conductor disposed on the second portion of the support member generally in the mirror image of the first pattern;

a fourth conductor disposed on the second portion of the support member generally in the mirror image of in the second pattern; and a pressure responsive semiconducting composition disposed for overlying at least one of the first, second, third and fourth conductors for providing a contact resistor thereon;

the support member being folded for transversely aligning the first and third conductors and the second and fourth conductors in normally spaced apart relationship, the pair of the first and third conductors and the pair of the second and fourth conductors being laterally positioned in simultaneous actuating proximity, the first and third conductors transversely movable into electrically conducting relationship and the second and fourth conductors transversely movable into electrically conducting relationship in response to the single transverse force.

8. The dual switch apparatus of claim 7 further comprising a spacer positioned between the first and second portions and surrounding the first, second, third and fourth conductors for maintaining the first and third pair of conductors and the second and fourth pair of conductors in normally spaced apart relationship.

9. A tone generating device comprising:

a switch apparatus defining a pair of switches simultaneously actuated in response to a single transverse force, the switch apparatus comprising:

a first support member;

a first conductor disposed on the first support member;

a second conductor disposed on the first support member;

a second support member;

a third conductor disposed on the second support member;

a fourth conductor disposed on the second support member;

the first and second support members juxtaposed opposite one another in normally spaced apart relationship with the first and third conductors and the second and fourth conductors transversely aligned and laterally spaced in simultaneously actuating proximity, the first and third conductors transversely movable into electrically conducting relationship and the second and fourth conductors transversely movable into electrically conducting relationship in response to the application of the single transverse force; and a pressure responsive semiconducting composition disposed between at least one of the first and third pair of conductors and the second and fourth pair of conductors for providing a contact resistance thereacross, the contact resistance varying in response to variations in the magnitude of the single transverse force;

a first utilization circuit coupled between the first and third conductors; and a second utilization circuit coupled between the second and fourth conductors.

10. The tone generating device of claim 9 wherein the dual switch apparatus further comprises a spacer surrounding the first, second, third and fourth conductors for maintaining the first and third pair of conductors and the second and fourth pair of conductors in the normally spaced apart relationship.

11. A tone generating device comprising:

a dual switch apparatus defining a pair of switches simultaneously actuated in response to a single transverse force, the dual switch apparatus comprising:

a foldable support member having a first portion and a second portion;

a first conductor disposed on the first portion of the support member;

a second conductor disposed on the first portion of the support member;

a third conductor disposed on the second portion of the support member;

a fourth conductor disposed on the second portion of the support member; and a pressure responsive semiconductor composition disposed for overlaying at least one of the first, second, third and fourth conductors for providing a contact resistance thereon;

the support member being folded for transversely aligning the first and third conductors with the second and fourth conductors in normally spaced apart relationship, the first and third conductors defining a first of the pair of switches, the first and third conductors transversely movable into electrical conducting relationship, and the second and fourth conductors, defining the second of the pair of switches, being transversely movable into electrically conducting relationship, the first and second switches being simultaneously actuated in response to the single transverse force;

a first utilization circuit coupled between the first and third conductors; and a second utilization circuit coupled between the second and fourth conductors.

12. The dual tone generating device of claim 11 wherein the dual switch apparatus further comprises a spacer positioned between the first and second portions and surrounding the first, second, third and fourth conductors for maintaining the first and third conductors and the second and fourth conductors in normally spaced apart relationship.

* * * * *